US009784078B2

(12) United States Patent
Holly et al.

(10) Patent No.: US 9,784,078 B2
(45) Date of Patent: Oct. 10, 2017

(54) MULTI-PERFORATING TOOL

(71) Applicant: HALLIBURTON ENERGY SERVICES, INC., Houston, TX (US)

(72) Inventors: Mark S. Holly, Singapore (SG); Nikhil Manmadhan Kartha, Singapore (SG)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 211 days.

(21) Appl. No.: 14/647,877

(22) PCT Filed: Apr. 24, 2014

(86) PCT No.: PCT/US2014/035271
§ 371 (c)(1),
(2) Date: May 28, 2015

(87) PCT Pub. No.: WO2015/163879
PCT Pub. Date: Oct. 29, 2015

(65) Prior Publication Data

US 2016/0305226 A1 Oct. 20, 2016

(51) Int. Cl.
*E21B 43/11* (2006.01)
*E21B 43/112* (2006.01)
*E21B 23/00* (2006.01)

(52) U.S. Cl.
CPC ..... *E21B 43/112* (2013.01); *E21B 23/006* (2013.01)

(58) Field of Classification Search
CPC ..... E21B 43/112; E21B 43/11
USPC ..... 166/297, 299, 55.2, 55.3
See application file for complete search history.

(56) References Cited

U.S. PATENT DOCUMENTS

| | | | |
|---|---|---|---|
| 2,998,068 | A | 8/1961 | True |
| 3,154,147 | A | 10/1964 | Lanmon, II |
| 3,209,828 | A | 10/1965 | Lebourg |
| 3,294,163 | A | 12/1966 | Lebourg |
| 4,727,763 | A | 3/1988 | Georget et al. |
| 4,949,788 | A | 8/1990 | Szarka et al. |
| 4,991,654 | A | 2/1991 | Brandell et al. |
| 5,259,466 | A | 11/1993 | Venditto et al. |
| 5,381,862 | A | 1/1995 | Szarka et al. |

(Continued)

OTHER PUBLICATIONS

International Application No. PCT/US2014/035271 , International Search Report and Written Opinion, mailed Jan. 23, 2015, 14 pages.

*Primary Examiner* — Kenneth L Thompson
(74) *Attorney, Agent, or Firm* — Kilpatrick Townsend & Stockton LLP

(57) ABSTRACT

A multi-perforating assembly can include a housing containing a rotor. The rotor can be axially stroked by a multi-stroker tool. Upon axial movement, the rotor can cooperate with the housing to incrementally rotate. Axial movement of the rotor can cause a multi-perforating cartridge to radially pierce. Rotation of the rotor combined with piercing of the multi-perforating cartridge can enable multiple piercings to be easily and quickly performed in a single run. A multi-perforating cartridge can include a blade pivotally attached to a slider. The blade can be pulled past ports in a cartridge housing whereupon biasing springs can push the blade into the ports and a support pin can push the blade into piercing positions before pushing the blade into transitional positions, after which the blade can be biased into the subsequent port.

17 Claims, 13 Drawing Sheets

(56) References Cited

U.S. PATENT DOCUMENTS

| | | | | |
|---|---|---|---|---|
| 6,098,716 | A | 8/2000 | Hromas et al. | |
| 7,347,273 | B2 | 3/2008 | George et al. | |
| 7,497,259 | B2 | 3/2009 | Leising et al. | |
| 7,740,059 | B1 * | 6/2010 | Spencer | E21B 43/11 166/55.2 |
| 2004/0112591 | A1 | 6/2004 | Wright et al. | |
| 2004/0140126 | A1 | 7/2004 | Hill et al. | |
| 2007/0181308 | A1 | 8/2007 | Jelsma et al. | |
| 2007/0277980 | A1 | 12/2007 | Gordon et al. | |
| 2008/0110644 | A1 | 5/2008 | Howell et al. | |
| 2008/0314591 | A1 | 12/2008 | Hales et al. | |
| 2008/0314600 | A1 | 12/2008 | Howard et al. | |
| 2009/0107680 | A1 | 4/2009 | Surjaatmadja et al. | |
| 2009/0133876 | A1 | 5/2009 | Surjaatmadja et al. | |
| 2010/0193192 | A1 | 8/2010 | Buckman et al. | |
| 2010/0236781 | A1 | 9/2010 | Mytopher et al. | |
| 2010/0326659 | A1 | 12/2010 | Schultz et al. | |
| 2011/0000670 | A1 | 1/2011 | Springett et al. | |
| 2011/0162846 | A1 | 7/2011 | Palidwar et al. | |
| 2012/0055671 | A1 | 3/2012 | Stromquist et al. | |
| 2012/0067582 | A1 | 3/2012 | Fincher et al. | |
| 2012/0273198 | A1 | 11/2012 | Gette et al. | |
| 2013/0186619 | A1 | 7/2013 | Wicks et al. | |
| 2013/0264049 | A1 | 10/2013 | Mireles et al. | |
| 2015/0300135 | A1 * | 10/2015 | Micak | E21B 43/112 166/298 |

* cited by examiner

MULTI-PERFORATING TOOL

CROSS-REFERENCE TO RELATED APPLICATIONS

This is a U.S. national phase under 35 U.S.C. 371 of International Patent Application No. PCT/US2014/035271, titled "Multi-Perforating Tool" and filed Apr. 24, 2014, the entirety of which is incorporated herein by reference.

TECHNICAL FIELD

The present disclosure relates to oilfield operations generally and more specifically to perforators.

BACKGROUND

Perforating tools can be used in wells to punch holes through casings and other tubulars to provide a path for fluid flow. Perforating tools can further be used to pierce into formation surrounding a wellbore. Tools can punch single holes per run. Punching multiple holes per run can be challenging.

BRIEF DESCRIPTION OF THE DRAWINGS

The specification makes reference to the following appended figures, in which use of like reference numerals in different figures is intended to illustrate like or analogous components.

DETAILED DESCRIPTION

Figure 1:
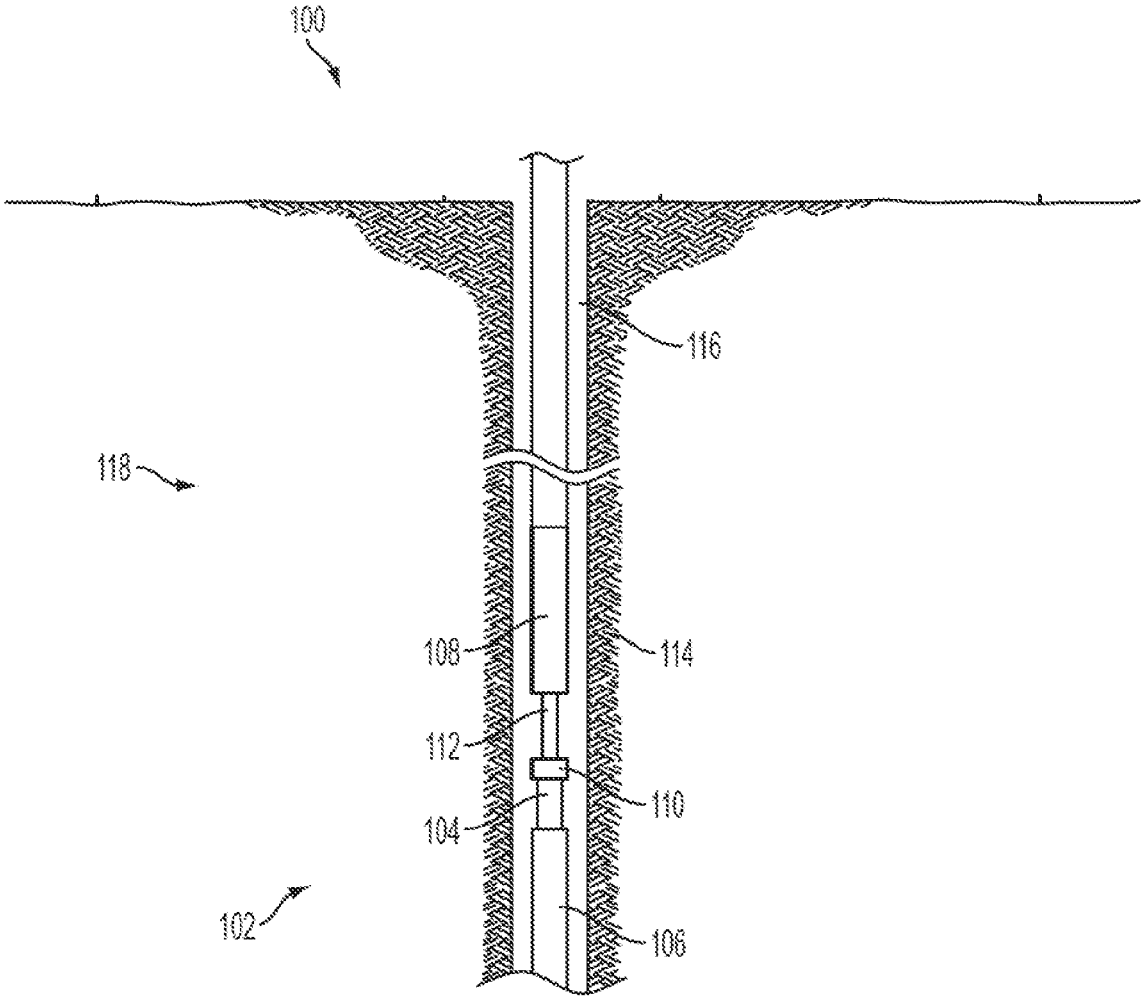
FIG. 1 is a schematic diagram of a wellbore including a multi-perforating assembly according to one embodiment.

Certain aspects and features of the present disclosure relate to a multi-perforating assembly that can create a series of rotationally spaced-apart piercings. The assembly can include a rotor that can incrementally rotate with forward and reverse axial motion. A multi-perforating cartridge can pierce a casing, another tubular, or a formation in response to axial movement of the rotor. The rotor can be attached to a multi-stroker tool with a swivel joint. The multi-stroker tool can generate forward and reverse axial movement of the rotor.

The multi-stroker tool can generate a number of forward and reverse axial movements (i.e., strokes) of the rotor, causing the rotor to rotate within the housing of the multi-perforating assembly. The rotor can be rotationally free with respect to the multi-stroker tool so rotation of the rotor does not cause rotation of the multi-stroker tool. The rotor can be attached to a shaft of the multi-stroker tool by a swivel joint.

The rotor can include rotor guiding arms that engage grooves in the housing of the multi-perforating assembly. A first rotor guiding arm can engage a first groove during reverse strokes. The first groove can be shaped in a saw-tooth-type shape. When the first rotor guiding arm engages the first grove, the rotor turns a finite amount in a first direction (e.g., counter-clockwise from the bottom of the assembly). As used herein, the term "top" refers to ends closer to the surface of a well, while "bottom" refers to ends closer to the end of the well. The amount of rotation is dictated by the profile of the first groove. A second rotor guiding arm can engage a second groove during forward strokes. The second groove can be shaped in a sawtooth-type shape, but offset from the first groove. When the second rotor guiding arm engages the first groove, the rotor turns a finite amount in the first direction, where the amount of rotation is dictated by the profile of the second groove. The first groove and second groove can be offset so that a full stroke in one direction can align the opposite rotor guiding arm with a slanted profile of the opposite groove. Reciprocating motion of the multi-stroker tool can be converted into incremental rotation of the rotor.

Axial movement of the rotor can cause a multi-perforating cartridge to pierce. A multi-perforating cartridge is a device designed to pierce multiple times in a single run. A multi-perforating cartridge can be designed to perforate, take core samples, or perform other types of piercing actions. The multi-perforating cartridge can include a slider that is moved axially along with axial movement of the rotor. A blade can be pivotally attached to a pivot pin in the slider, allowing the blade to pivot between the top and bottom of the slider. The multi-perforating cartridge can include a cartridge housing that includes a first port and a second port. A support pin or other structure can be situated between the first port and the second port. The slider can include springs, such as bow springs, that bias the blade radially outwards, away from the slider. As the blade moves axially along with the slider, the springs can cause the tip of the blade to be pushed into or out through the first and second ports. While the blade continues to be moved axially, the blade can be pressed against the support pin or other structure, causing the tip of the blade to extend further in a radially outwards direction. During radial outwards movement, the blade can pierce or perforate any object in the path of the blade. In some embodiments, the multi-perforating assembly can additionally include a number of exterior ports that align with the first port and the second port at each rotational position where the multi-perforating cartridge can pierce. In alternate embodiments, the blade can pierce through the multi-perforating assembly. In use, any combination of casings, other tubulars, or the formation can be located sufficiently close to the outer diameter of the multi-perforating assembly housing that the tubulars or formation can be pierced by the blade during axial movement of the rotor. As the slider continues to move axially, the blade can be pushed inwards, towards the slider, by interaction with the support pin or other structure, and can be biased outwards again into the other port by the springs once the blade passes under the support pin or other structure. The process is thus repeatable to perform piercings in both the forward and reverse directions.

As used herein, the terms "forward direction" and "reverse direction" refer to a direction towards the end of the well and a direction towards the surface of the well, respectively.

These illustrative examples are given to introduce the reader to the general subject matter discussed here and are not intended to limit the scope of the disclosed concepts. The following sections describe various additional features and examples with reference to the drawings in which like numerals indicate like elements, and directional descriptions are used to describe the illustrative embodiments but, like the illustrative embodiments, should not be used to limit the present disclosure. The elements included in the illustrations herein may be drawn not to scale.

FIG. 1 is a schematic diagram of a wellbore servicing system 100 including a multi-perforating assembly 102 according to one embodiment. The wellbore servicing system 100 includes a wellbore 116 penetrating a subterranean formation 114 for the purpose of recovering hydrocarbons, storing hydrocarbons, disposing of carbon dioxide, or the like. The wellbore 116 can be drilled into the subterranean formation 114 using any suitable drilling technique. While shown as extending vertically from the surface in FIG. 1, in other examples the wellbore 116 can be deviated, horizontal, or curved over at least some portions of the wellbore 116. The wellbore 116 can be cased, open hole, contain tubing, and can include a hole in the ground having a variety of shapes or geometries.

A service rig, such as a drilling rig, a completion rig, a workover rig, or other mast structure or combination thereof can support a workstring 118 in the wellbore 116, but in other examples a different structure can support the workstring 118. For example, an injector head of a coiled tubing rigup can support the workstring 118. In some aspects, a service rig can include a derrick with a rig floor through which the workstring 118 extends downward from the service rig into the wellbore 116. The servicing rig can be supported by piers extending downwards to a seabed in some implementations. Alternatively, the service rig can be supported by columns sitting on hulls or pontoons (or both) that are ballasted below the water surface, which may be referred to as a semi-submersible platform or rig. In an off-shore location, a casing may extend from the service rig to exclude sea wager and contain drilling fluid returns. Other mechanical mechanisms that are not shown may control the run-in and withdrawal of the workstring 118 in the wellbore 116. Examples of these other mechanical mechanisms include a draw works coupled to a hoisting apparatus, a slickline unit or a wireline unit including a winching apparatus, another servicing vehicle, and a coiled tubing unit.

The workstring 118 can include a multi-perforating assembly 102 and a multi-stroker tool 108. The multi-perforating assembly 102 can include a rotor 104 at least partially located within a housing 106. The rotor 104 can be coupled to a push rod 112 of a multi-stroker tool 108 by a swivel joint 110.

Figure 2:
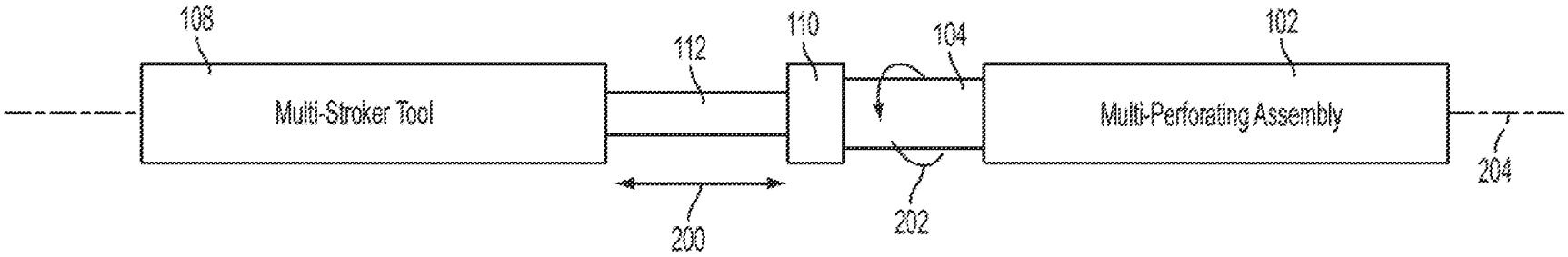
FIG. 2 is a schematic diagram of a multi-stroker and a multi-perforating assembly according to one embodiment.

FIG. 2 is a schematic diagram of the multi-stroker tool 108 and multi-perforating assembly 102 of FIG. 1 according to one embodiment. The multi-stroker tool 108 can be actuated in many ways, including electromechanical and hydraulic. The multi-stroker tool 108 can be any device capable of moving the rotor 104 linearly, parallel to a central axis 204 of the multi-perforating assembly 102. Arrow 200 indicates the direction of linear travel of the push rod 112 of the multi-stroker tool 108. Arrow 202 indicates the direction of rotation of the rotor 104. In alternate embodiments, the rotor 104 rotates in a direction opposite arrow 202. The swivel joint 110 can rotationally decouple the rotor 104 from the push rod 112, and therefore from the multi-stroker tool 108. In alternate embodiments, the multi-stroker tool 108 is capable of directly, linearly actuating the rotor 104. The rotor 104 can still be rotationally decoupled from the multi-stroker tool 108.

As seen in FIG. 2, the "bottom" of the multi-perforating assembly 102 is towards the right of the figure, while the "top" is towards the left.

Figure 3:
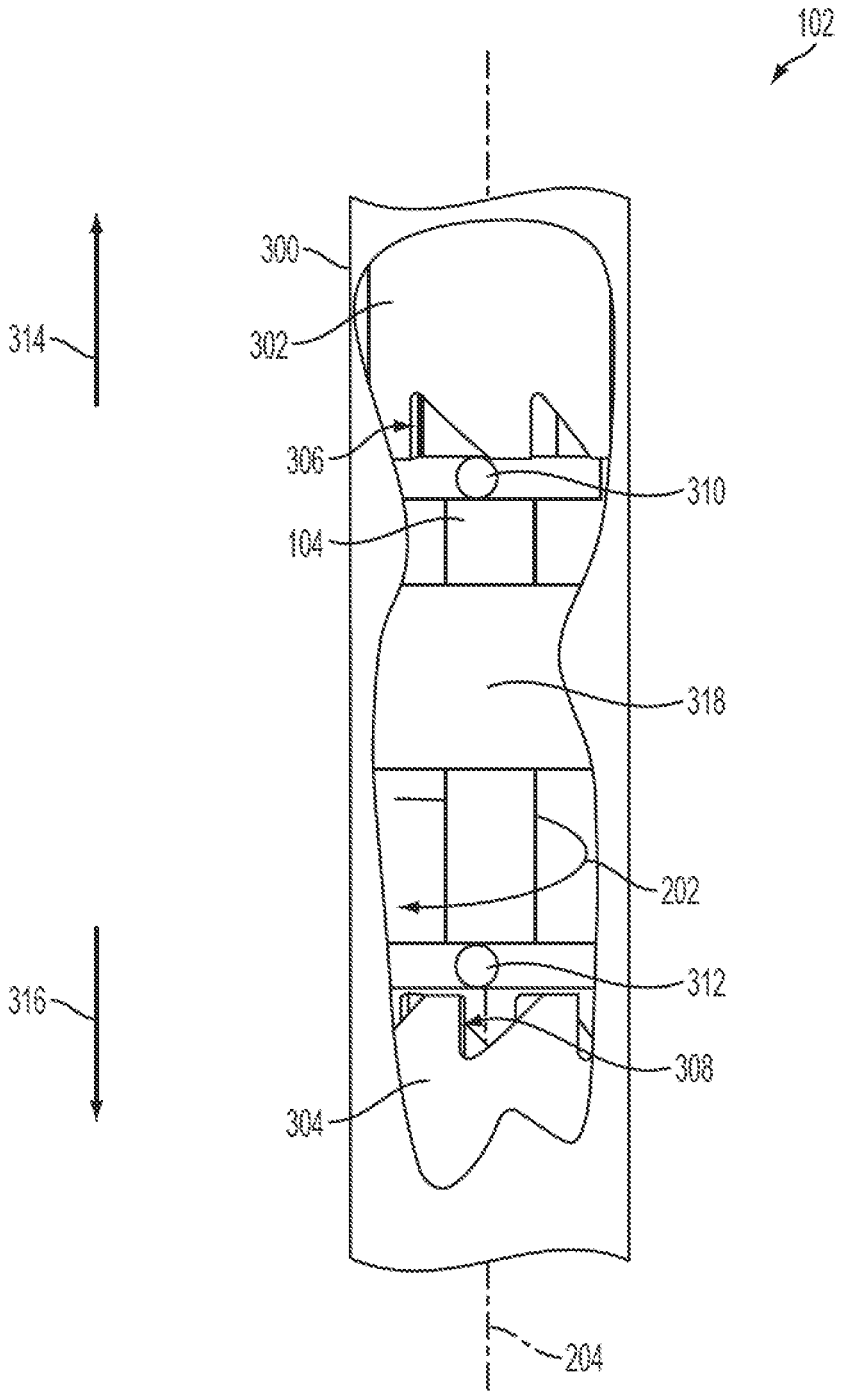
FIG. 3 is a partial, cutaway view of a multi-perforating assembly according to one embodiment.

FIG. 3 is a partial, cutaway view of the multi-perforating assembly 102 of FIG. 1 according to one embodiment. The multi-perforating assembly 102 includes a housing 300. The housing 300 can include a first guide 302 and a second guide 304. The first guide 302 and second guide 304 can be a part of the housing 300 itself or can be separate pieces located within the housing 300. The first guide 302 includes a first profile 306. The second guide 304 can include a second profile 308.

A first rotor guiding arm 310 and a second rotor guiding arm 312 can be fixed to the rotor 104 to move axially and rotationally with the rotor 104. As the rotor 104 moves in a reverse direction 314, the first rotor guiding arm 310 can engage the first profile 306 of the first guide 302 to rotate the rotor 104 incrementally in direction 202. As the rotor 104 moves in a forward direction 316, the second rotor guiding arm 312 can engage the second profile 308 of the second guide 304 to rotate the rotor 104 incrementally in direction 202.

The first profile 306 and the second profile 308 can each be sawtooth-shaped. The first profile 306 can be offset from the second profile 308 so that after an axial movement of the rotor 104 in a reverse direction 314, where the first rotor guiding arm 310 rests in a recess of the first profile 306, the second rotor guiding arm 312 can be aligned above an incline of the second profile 308. The first rotor guiding arm 310 and the second rotor guiding arm 312 can cooperate with the first profile 306 and second profile 308, respectively, to rotate the rotor 104 by increments during axial movement of the rotor. The amount of rotation of the rotor 104 can be controlled by changing the shape of the first profile 306 and the second profile 308. For example, a profile with fewer teeth would result in the rotor 104 rotating further during each axial movement and rotating through fewer positions during a full 360° rotation.

In alternate embodiments, only a first rotor guiding arm 310 can be used and the first rotor guiding arm 310 can cooperate with a first guide 302 that includes a first profile 306 that is a J-slot type profile. The first rotor guiding arm 310 can engage the first profile 306 during linear movement in both the reverse direction 314 and the forward direction 316.

In other embodiments, the rotor 104 can include a structure rotationally coupled to the rotor 104 that includes one or more profiles that cooperate with one or more pins held rotationally fixed with respect to the housing 300. Axial movement of the rotor 104 can cause the profiles of the structure to engage the pins of the housing to rotate the rotor 104.

In yet further embodiments, other structures can be used to translate axial movement of the rotor in one or both directions into rotational movement.

The multi-perforating assembly 102 can further includes a cartridge housing 318. The cartridge housing 318 can include one or more cartridges that are actuated in response to axial movement of the rotor 104.

In one embodiment, the cartridge housing 318 can include a single multi-perforating cartridge as described in further detail below. The cartridge housing 318 can be held axially fixed with respect to the housing 300, but can remain rotationally free with respect to the housing 300. The cartridge housing 318 can be axially free with respect to the rotor 104, but can be held rotationally fixed with respect to the rotor 104. Axial movement of the rotor 104 can cause the cartridge housing 318 to rotate within the housing 300 according to the rotation of the rotor 104 without resulting in axial movement of the cartridge housing 318. The cartridge housing 318 can be held axially fixed and rotationally free with respect to the housing 300 by clips, grooves, shoulders, or other applicable structures. The cartridge housing 318 can be held rotationally fixed but axially free with respect to the rotor 104 by tongue and groove arrangements, prismatic joints, or other suitable arrangements, including as described below.

In another embodiment, the cartridge housing 318 can include single-use or multi-use cartridges rotationally spaced apart. The cartridge housing 318 can be held axially and rotationally fixed with respect to the housing 300. As the rotor 104 rotates within the cartridge housing 318, the rotor 104 can actuate subsequent ones of the plurality of cartridges.

Embodiments have been described including a rotor 104 that rotates within a housing 300 and that is rotationally isolated from a multi-stroker tool 108. In alternate embodiments, the rotor 104 is not rotationally isolated from the multi-stroker tool 108 and does not rotate. Rather, the rotor 104 can move only axially. The cartridge housing 318 and the rotor 104 can each have corresponding structures that cause rotation of the cartridge housing 318 with each linear movement of the rotor 104. The corresponding structures can be profiles and pins, as described above, or other suitable structures.

Figure 4:
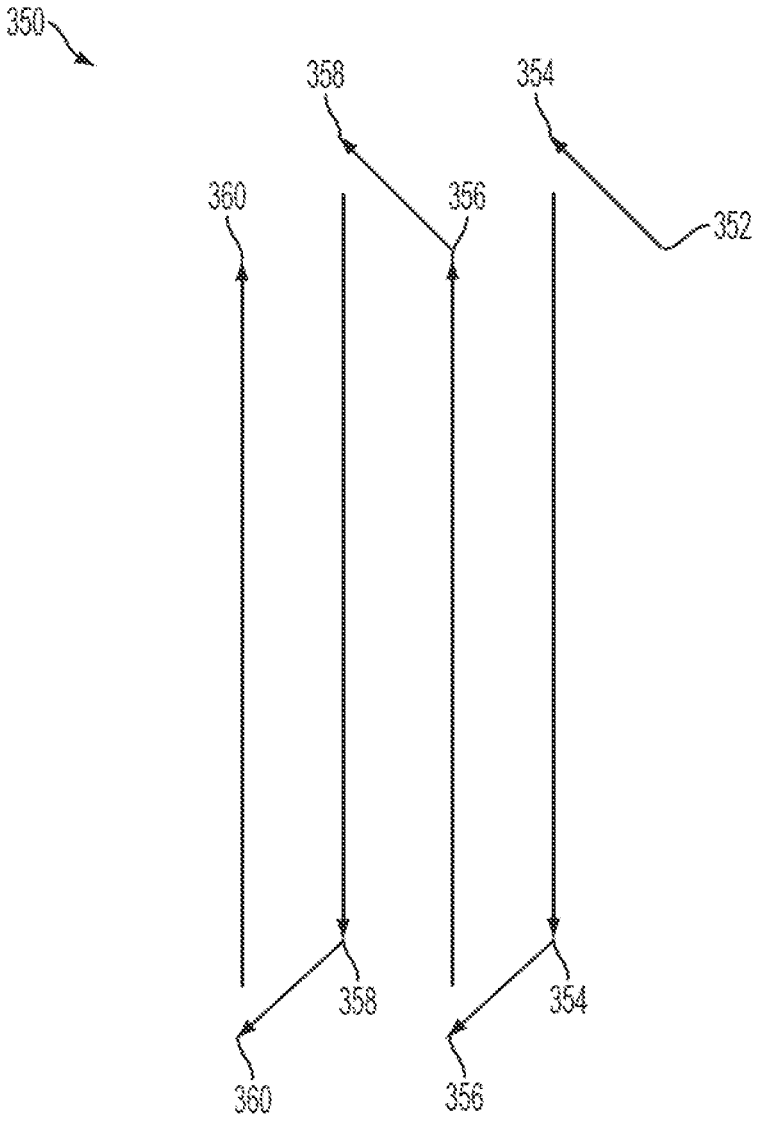
FIG. 4 is a flat visual representation of a rotational path of the rotor of FIG. 3 according to one embodiment.

FIG. 4 is a flat visual representation of a rotational path 350 of the rotor 104 of FIG. 3 according to one embodiment. As described herein, each position refers to further degrees of rotation about central axis 204. The rotor 104 can begin at a first position 352. Upon axial movement in the reverse direction 314, the rotor 104 can rotate to a second position 354. The rotor 104 can then move axially in a forward direction 316 until the second rotor guiding arm 312 cams against the second profile 308, rotating the rotor 104 to a third position 356. The rotor 104 can then move axially in a reverse direction 314 until the first rotor guiding arm 310 cams against the first profile 306, rotating the rotor 104 to a fourth position 358. The process can repeat to move the rotor 104 to a fifth position 360.

Figure 5:
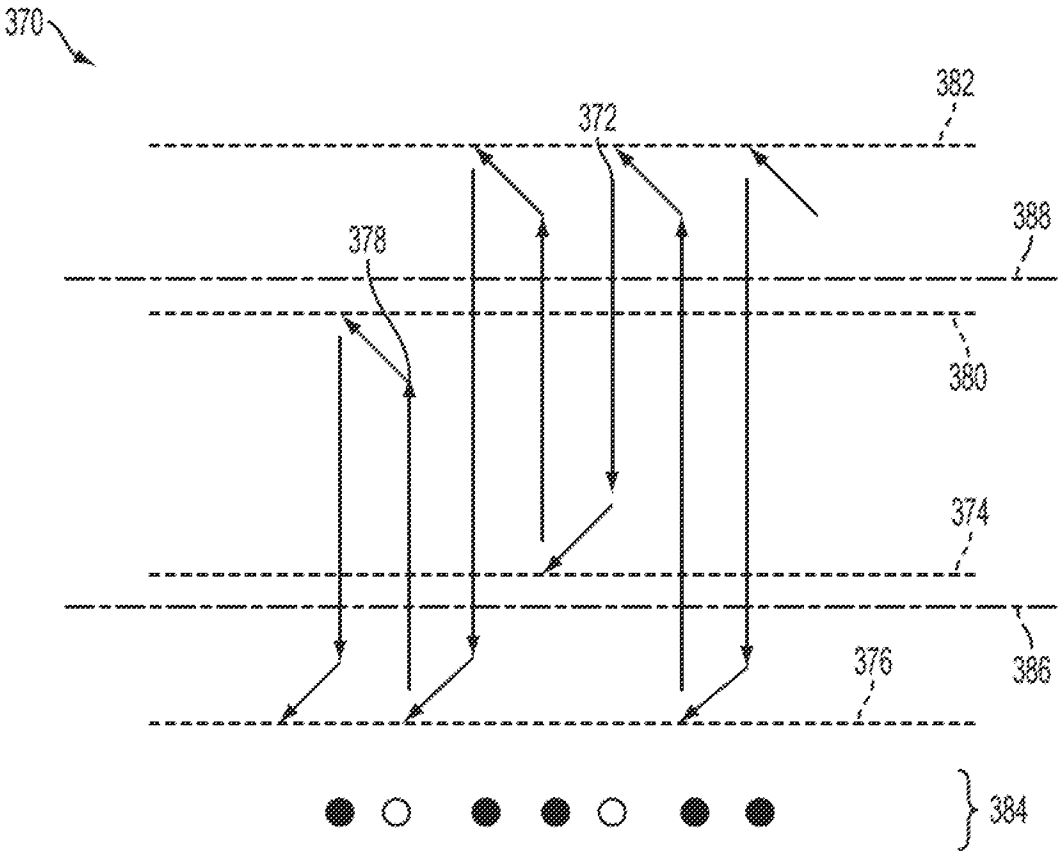
FIG. 5 is a flat visual representation of an alternate rotational path of a rotor according to one embodiment.

FIG. 5 is a flat visual representation of an alternate rotational path of a rotor 104 according to one embodiment. While FIG. 3 depicts a first profile 306 and a second profile 308 each with regular patterns of recesses and inclines, in alternate embodiments, one or both of the first profile 306 and the second profile 308 can have recesses with differing depths. FIG. 5 is a flat visual representation of an alternate rotational path 370 where both of the first profile 306 and second profile 308 can have recesses with differing depths.

In position 372, the recess depth in the second profile 308 is shallow, so the rotor 104 can only travel axially to a partial forward extent 374. The partial forward extend 374 is not as far as the full forward extent 376. A perforating cartridge can be structured and positioned to only pierce if the rotor 104 extends past the partial forward extent 374 to a forward piercing extent 386. In position 372, the rotor 104 does not extend past the partial forward extent 374, and thus the perforating cartridge does not pierce. Likewise, in position 378, the recess depth in the first profile 306 is shallow, so the rotor 104 can only travel axially to a partial reverse extent 380. The partial reverse extent 380 is not as far as the full reverse extent 382. The perforating cartridge can be structured and positioned to only pierce if the rotor 104 extends past the partial reverse extent 380 to a reverse piercing extent 388. In position 378, the rotor 104 does not extend past the partial reverse extent 380 to the reverse piercing extent 388, and thus the perforating cartridge does not pierce.

A pattern 384 is shown, aligned to respective positions of the rotor 104, indicating the piercings that result from the alternate rotational path 370. Each black circle represents a piercing, while the white circles represent no piercing.

In alternate embodiments, one of the first profile 306 or second profile 308 can have recesses with varying depths.

By having different depth recesses at specific locations, the distance of linear travel of the rotor 104 can be controlled at specified rotational positions around each 360° rotation. When actuation of a perforating cartridge depends on a certain amount of linear travel of the rotor, it is possible to pre-set "skips" in the multi-perforating assembly 102, at certain rotational positions, where the rotor does not travel axially far enough to actuate a perforating cartridge. The multi-perforating assembly 102 can be pre-set to cause piercings only a certain specified increments relating to certain rotational positions.

Figure 6:
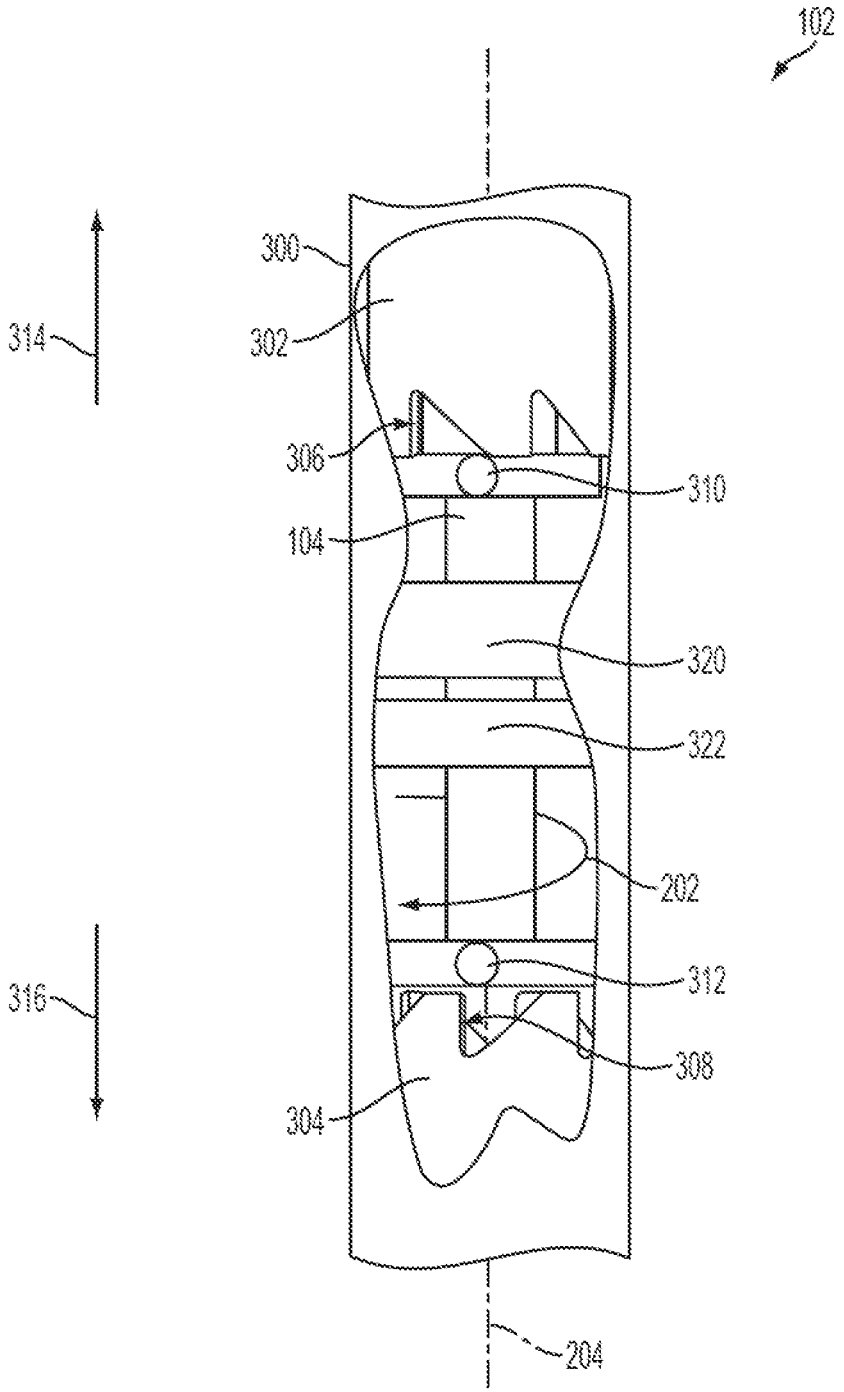
FIG. 6 is a partial, cutaway view of a multi-perforating assembly with stacked multi-perforating cartridges according to one embodiment.

FIG. 6 is a partial-cutaway view of a multi-perforating assembly 102 with stacked multi-perforating cartridges according to one embodiment. The multi-perforating assembly 102 can include a first multi-perforating cartridge 320 and a second multi-perforating cartridge 322 stacked one on top of the other. The first multi-perforating cartridge 320 can be axially spaced a distance apart from the second multi-perforating cartridge 322. In alternate embodiments, the first multi-perforating cartridge 320 can be adjacent the second multi-perforating cartridge 322. The use of stacked multi-perforating cartridges can allow additional piercings to be made per stroke. The first multi-perforating cartridge 320 can be rotationally aligned with the second multi-perforating cartridge 322 to pierce directly above the second multi-perforating cartridge 322. In alternate embodiments, the first multi-perforating cartridge 320 can be rotationally offset from the second multi-perforating cartridge 322 to create piercings offset from the piercings of the second multi-perforating cartridge 322.

As disclosed above, in some embodiments, a housing of a multi-perforating cartridge can rotate around a non-rotating rotor 104. In such embodiments, a first multi-perforating cartridge 320 can rotate in different increments and in a different direction than a second multi-perforating cartridge 322.

Figure 7:
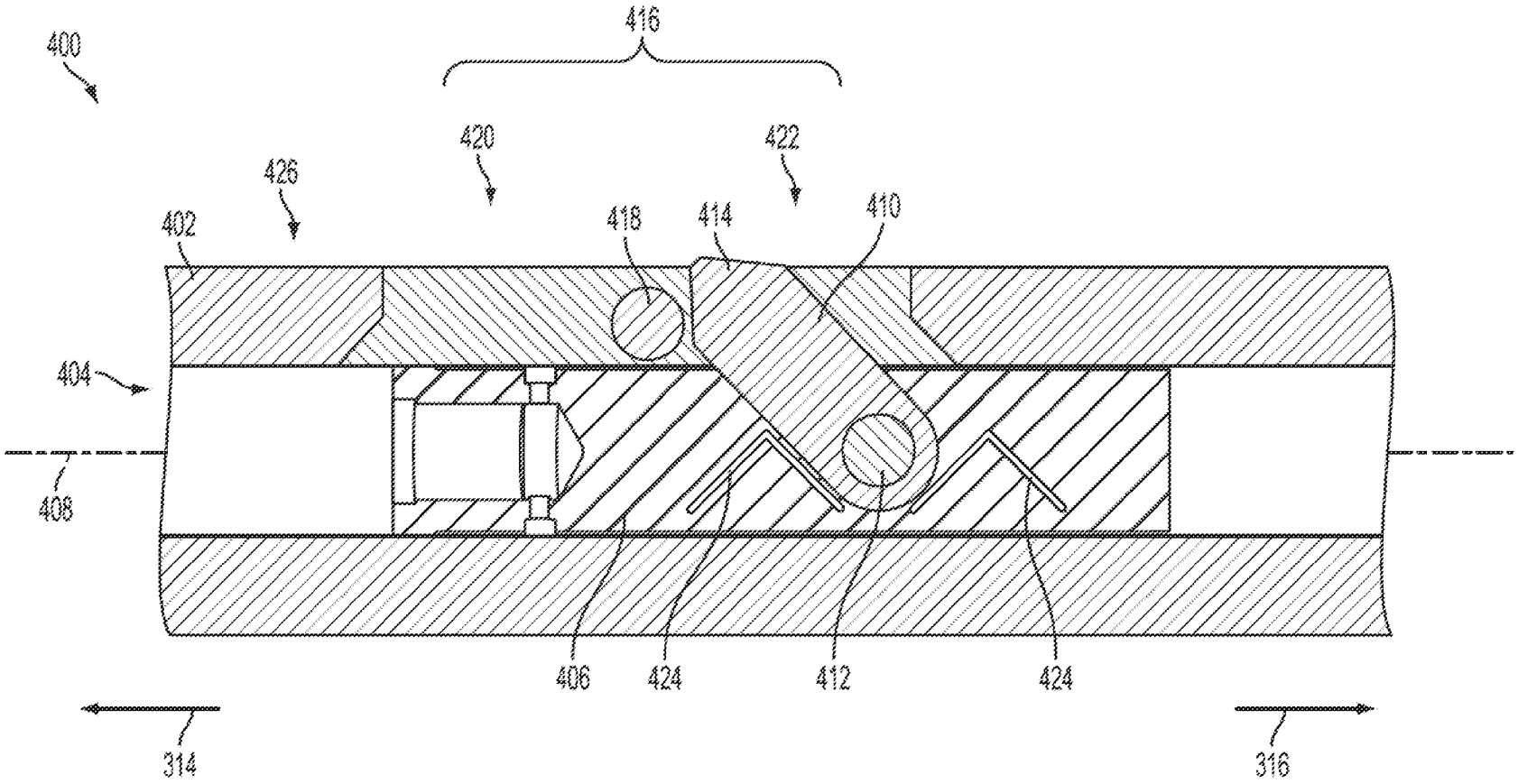
FIG. 7 is a cross-sectional view of a multi-perforating cartridge according to one embodiment.

FIG. 7 is a cross-sectional view of a multi-perforating cartridge 400 according to one embodiment. The multi-perforating cartridge 400 can include a cartridge housing 402 having an outer diameter 426. The housing can include a track 404 in which a slider 406 is able to move axially along axis 408. A blade 410 can be attached to the slider 406 and able to pivot on the slider 406. The blade 410 can be attached to the slider 406 by a pivot pin 412. The blade 410 can be free to rotate about the pivot pin 412. The blade 410 can include a tip 414. The slider 406 can be attached to the rotor 104. The rotor 104 is not shown in FIGS. 7-8H for clarity only and not to limit the disclosure or claims in any way. The slider 406 can move with the rotor 104 in both a reverse direction 314 and a forward direction 316.

The slider 406 can include one or more springs 424, such as bow springs. The springs 424 can bias the tip 414 of the blade 410 out of an opening 416 in the wall of the cartridge housing 402. A support pin 418 can be located in the opening 416, effectively splitting the opening 416 into a first port 420 and a second port 422. In alternate embodiments, the cartridge housing 402 does not have a single opening 416, but rather can have an individual first port 420 and individual second port 422 separated not by a support pin 418, but another structure, such as a block, a portion of the cartridge housing 402, or another suitable structure.

As described in further detail below, the slider 406 can move axially with the rotor 104, causing the blade 410 to move in and out of the first port 420 and second port 422.

Figure 8A:
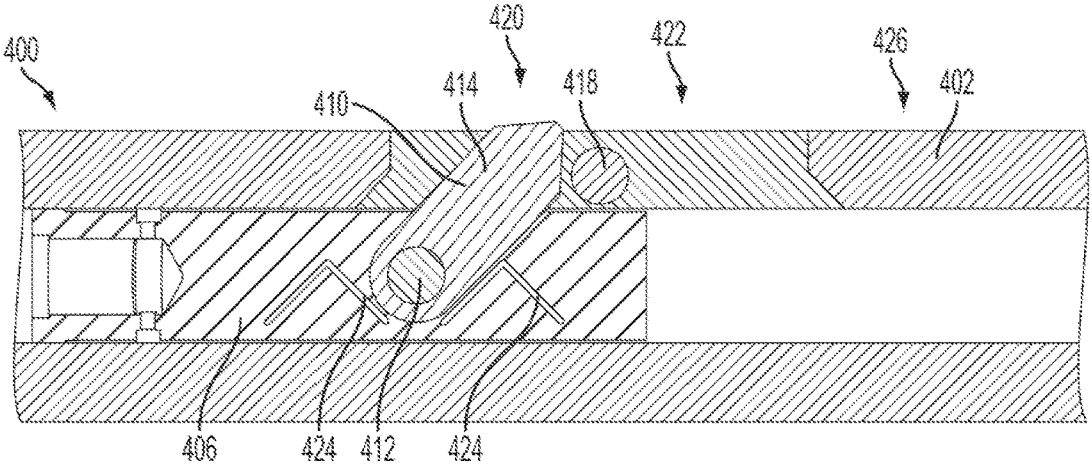
FIG. 8A is a cross-sectional view of the multi-perforating cartridge of FIG. 7 with the blade in a forward non-piercing position according to one embodiment.

FIG. 8A is a cross-sectional view of the multi-perforating cartridge 400 of FIG. 7 with the blade 410 in a forward non-piercing position according to one embodiment. The tip 414 of the blade 410 is resting within the first port 420.

Figure 8B:
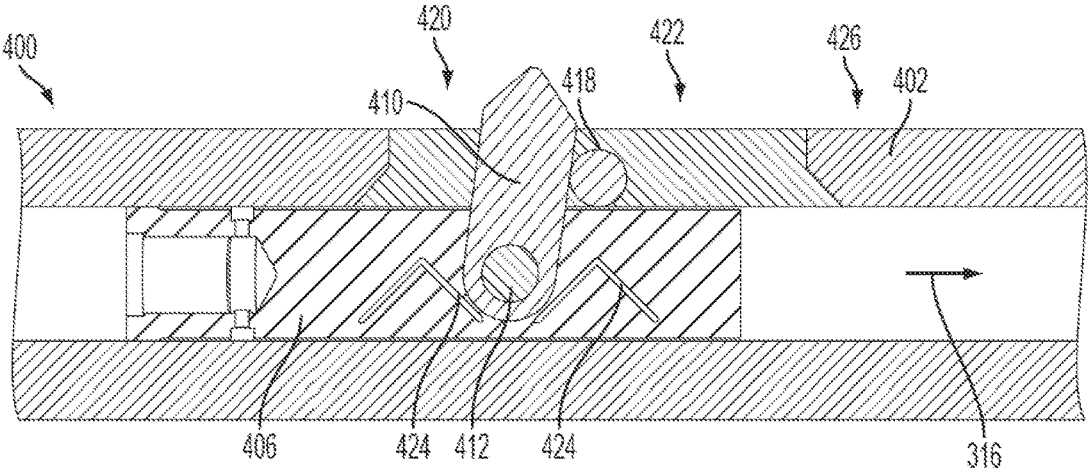
FIG. 8B is a cross-sectional view of the multi-perforating cartridge of FIG. 7 with the blade in a first piercing position according to one embodiment.

FIG. 8B is a cross-sectional view of the multi-perforating cartridge 400 of FIG. 7 with the blade 410 in a first piercing position according to one embodiment. Axial movement of the rotor 104 can cause the slider 406 to move in a forward direction 316. The blade 410, when pulled by the slider 406, can engage the support pin 418 and rotate around pivot pin 412, causing the tip 414 of the blade 410 to extend past the outer diameter 426 of the cartridge housing 402. The blade 410 is now extending out of the first port 420.

Figure 8C:
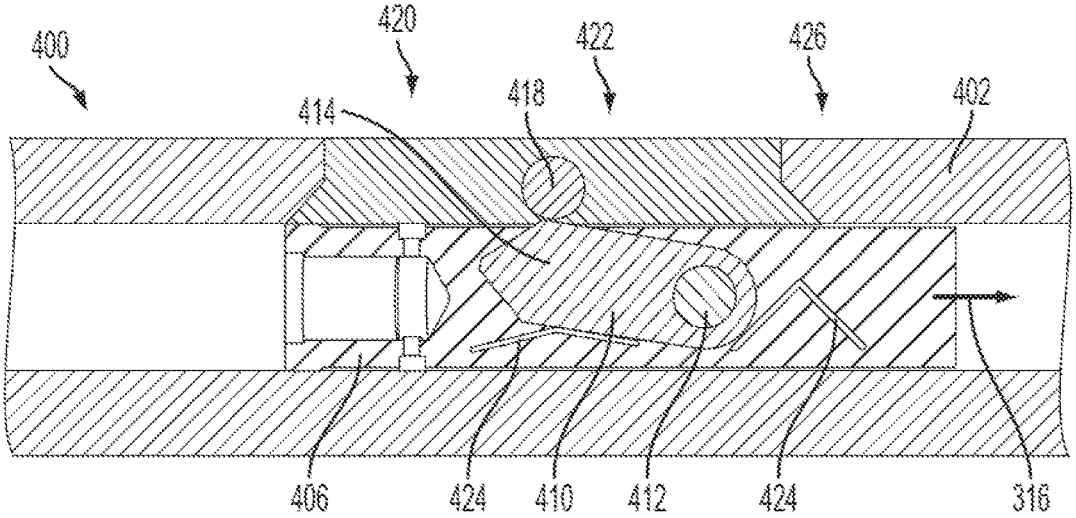
FIG. 8C is a cross-sectional view of the multi-perforating cartridge of FIG. 7 with the blade in a first transitional position according to one embodiment.

FIG. 8C is a cross-sectional view of the multi-perforating cartridge 400 of FIG. 7 with the blade 410 in a first transitional position according to one embodiment. Continued axial movement of the rotor 104 can cause the slider 406 to move further in a forward direction 316. The blade 410, when further pulled by the slider 406, can further engage the support pin 418 and rotated around pivot pin 412 to press down towards the slider 406 and compress one of the springs 424.

Figure 8D:
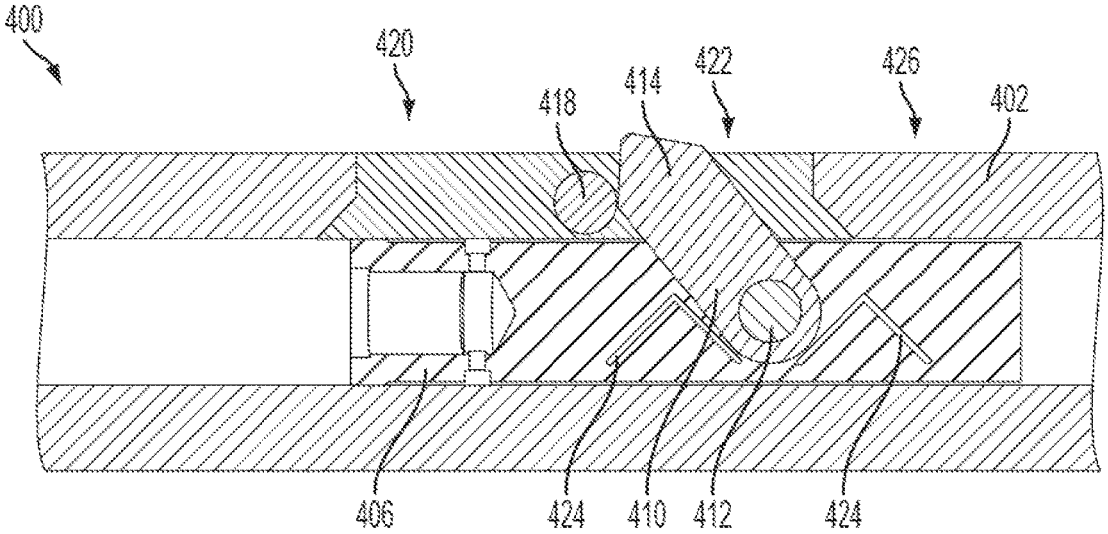
FIG. 8D is a cross-sectional view of the multi-perforating cartridge of FIG. 7 with the blade in a reverse non-piercing position according to one embodiment.

FIG. 8D is a cross-sectional view of the multi-perforating cartridge 400 of FIG. 7 with the blade 410 in a reverse non-piercing position according to one embodiment. Continued axial movement of the rotor 104 can cause the slider 406 to move further in a forward direction 316. The blade 410, when further pulled by the slider 406, can pass the support pin 418 and can be biased outwards, into the second port 422, by one of the springs 424. The tip 414 of the blade 410 is resting in the second port 422.

Figure 8E:
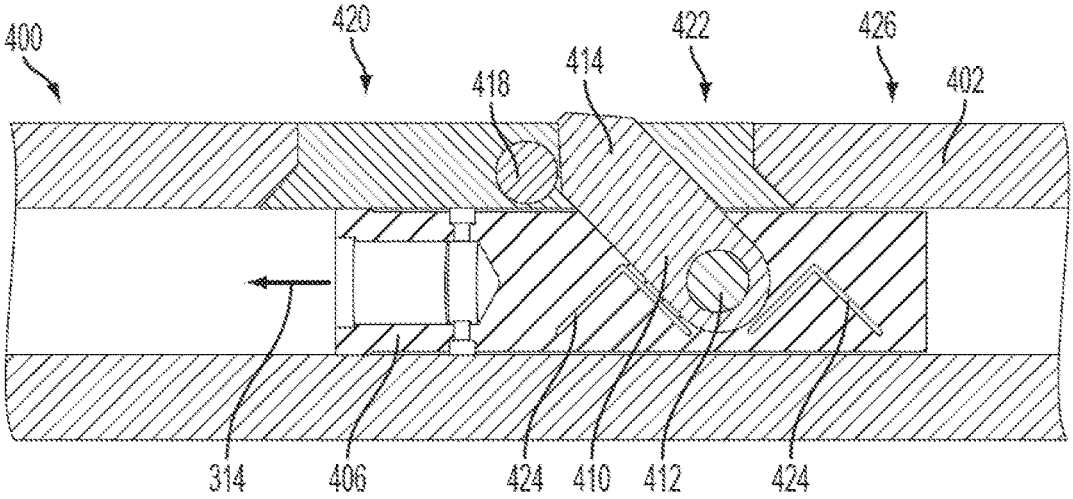
FIG. 8E is a cross-sectional view of the multi-perforating cartridge of FIG. 7 with the blade moving out of a reverse resting position according to one embodiment.

FIG. 8E is a cross-sectional view of the multi-perforating cartridge 400 of FIG. 7 with the blade 410 moving out of a reverse non-piercing position according to one embodiment. The tip 414 of the blade 410 is resting within the second port 422.

Figure 8F:
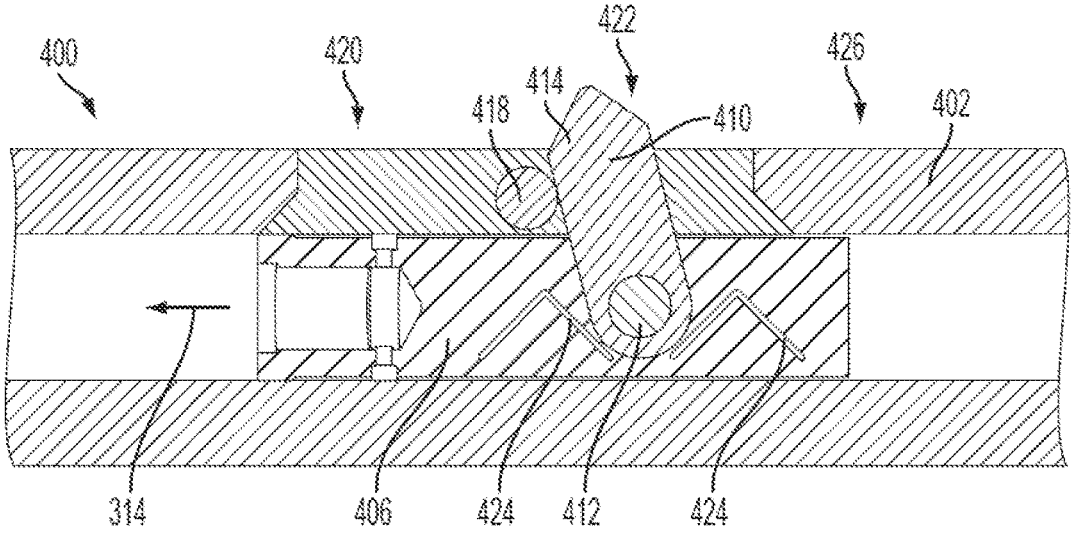
FIG. 8F is a cross-sectional view of the multi-perforating cartridge of FIG. 7 with the blade in a second piercing position according to one embodiment.

FIG. 8F is a cross-sectional view of the multi-perforating cartridge 400 of FIG. 7 with the blade 410 in a second piercing position according to one embodiment. Axial movement of the rotor 104 can caused the slider 406 to move in a reverse direction 314. The blade 410, when pulled by the slider 406, can engage the support pin 418 and rotate around pivot pin 412, causing the tip 414 of the blade 410 to extend past the outer diameter 426 of the cartridge housing 402. The blade 410 is now extending out of the second port 422.

Figure 8G:
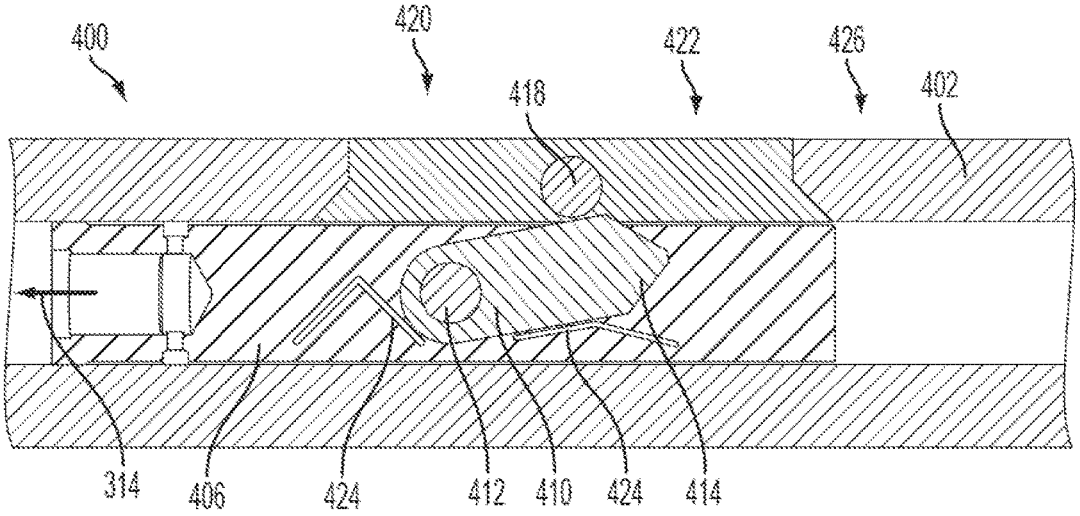
FIG. 8G is a cross-sectional view of the multi-perforating cartridge of FIG. 7 with the blade in a second transitional position according to one embodiment.

FIG. 8G is a cross-sectional view of the multi-perforating cartridge of FIG. 7 with the blade 410 in a second transitional position according to one embodiment. Continued axial movement of the rotor 104 can cause the slider 406 to move further in a reverse direction 314. The blade 410, when further pulled by the slider 406, can further engage the support pin 418 and rotated around pivot pin 412 to press down towards the slider 406 and compress one of the springs 424.

Figure 8H:
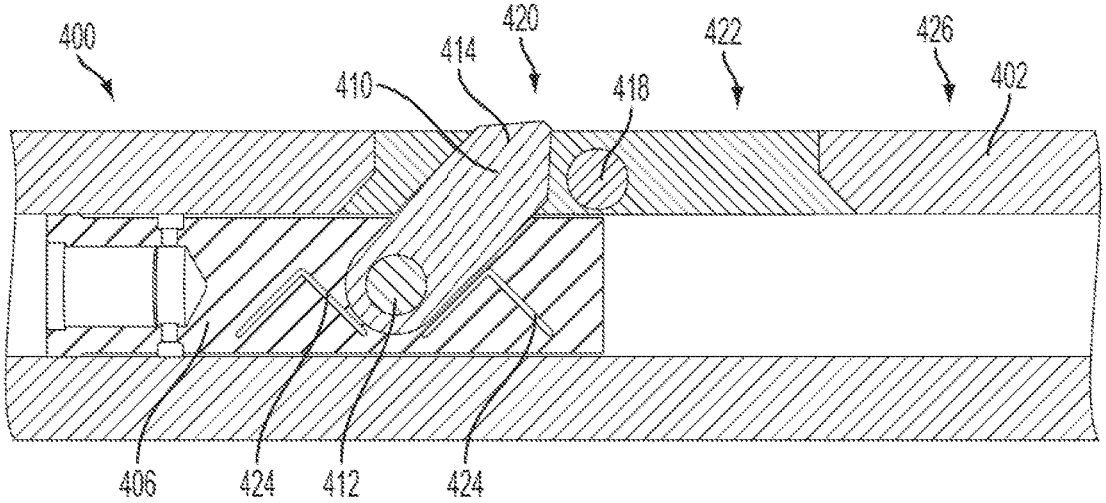
FIG. 8H is a cross-sectional view of the multi-perforating cartridge of FIG. 7 with the blade in a forward non-piercing position according to one embodiment.

FIG. 8H is a cross-sectional view of the multi-perforating cartridge of FIG. 7 with the blade 410 in a forward non-piercing position according to one embodiment. Continued axial movement of the rotor 104 can cause the slider 406 to move further in a reverse direction 314. The blade 410, when pulled further by the slider 406, can pass the support pin 418 and can be biased outwards, into the first port 420, by one of the springs 424. The tip 414 of the blade 410 is resting in the first port 420.

Full axial movement of the rotor 104 in a forward direction 316 and a reverse direction 314 can cause the multi-perforating cartridge 400 to pierce according to FIGS. 5A-5H. The process can be repeated numerous times, evidence by the fact that the state of the blade 410 of the multi-perforating cartridge 400 in FIG. 8A is identical to the state of the blade 410 of the multi-perforating cartridge 400 in FIG. 8H.

The rotor 104 can be rotationally fixed with respect to the slider 406, such as by threading, set screws, or another suitable device. Parts within the multi-perforating cartridge 400, including the slider 406, blade 410, or other parts can be structured and positioned to interact with the cartridge housing 402 during rotation, causing rotation of the cartridge housing 402. When the rotor 104 is rotated, the appropriate parts within the multi-perforating cartridge 400 can cause the cartridge housing 402 to rotate along with the rotor 104, thus effectively rotationally fixing the cartridge housing 402 to the rotor 104.

Figure 9A:
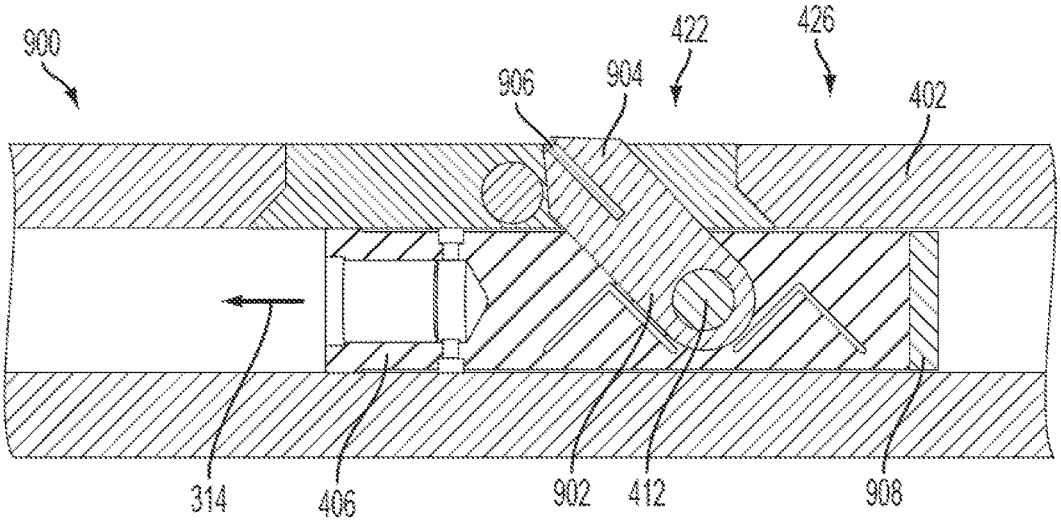
FIG. 9A is a cross-sectional view of a multi-perforating cartridge having a hollow blade according to one embodiment.

FIG. 9A is a cross-sectional view of a multi-perforating cartridge 400 having a hollow blade 902 according to one embodiment. The multi-perforating cartridge 400 can include a hollow blade 902 having a cavity 906 opening to a tip 904 of the hollow blade 902. The hollow blade 902 can be suitable for obtaining a core sample, such as a core sample from nearby formation.

Figure 9B:
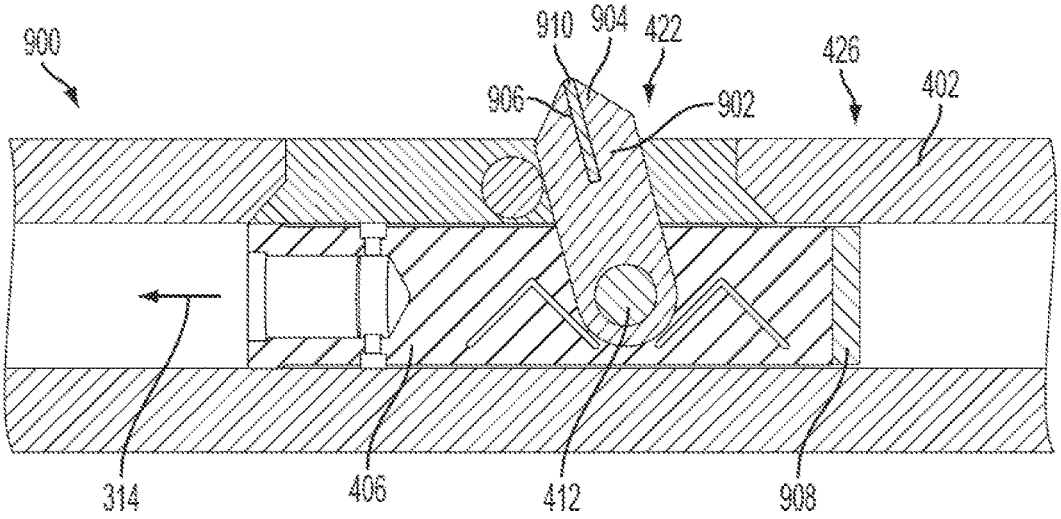
FIG. 9B is a cross-sectional view of the multi-perforating cartridge of FIG. 9A in a piercing position according to one embodiment.

FIG. 9B is a cross-sectional view of the multi-perforating cartridge 400 of FIG. 9A in a piercing position according to one embodiment. During piercing, as otherwise described above with reference to FIGS. 7-8H, the hollow blade 902 can pierce the formation surrounding the multi-perforating assembly 400 and obtain core samples 910 of the formation. The core samples 910 can fill or partially fill the cavity 906.

Figure 9C:
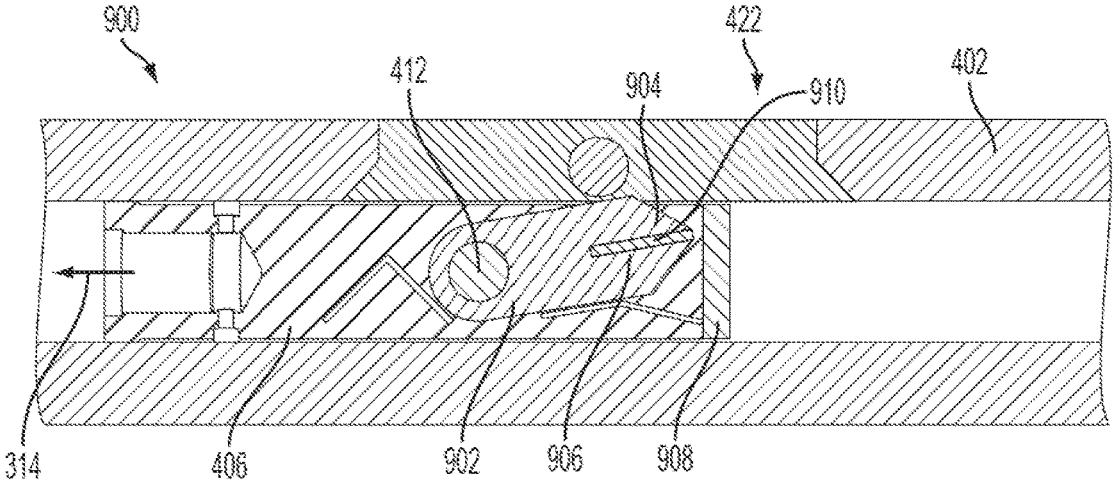
FIG. 9C is a cross-sectional view of the multi-perforating cartridge of FIG. 9A in a sealing position according to one embodiment.

FIG. 9C is a cross-sectional view of the multi-perforating cartridge 400 of FIG. 9A in a sealing position according to one embodiment. After having collected a core sample 910, when the hollow blade 902 is pulled in a reverse direction 314, the tip 904 of the hollow blade 902 can come into close proximity or into contact with an end cap 908. The end cap 908 operates to seal the core sample 910 within the hollow blade 902.

In additional embodiments, it is possible to change operation of the multi-perforating cartridge 400 between piercing-only and core-sampling by swapping out a standard blade 410 with a hollow blade 902. In alternate embodiments, the entire slider 406 can be swapped out, where one slider 406 includes a standard blade 410 and another includes a hollow blade 902.

In some embodiments, a multi-perforating cartridge 400 can contain a number of single-use cartridges including hollow blades 902. As described above, combined axial movement and rotational movement of the rotor 104 can cause each individual single-use cartridge to actuate at different times as the rotor moves through discrete rotational positions. The use of multiple single-use cartridges including hollow blades 902 allows for the multi-perforating assembly 102 to collect more than one core samples 910 at a time, including collecting core samples 910 from different radial positions around the multi-perforating assembly 102.

In some embodiments, the multi-perforating assembly 102 can be constructed to perform many piercings rotationally spaced in sufficiently close proximity to cut casing or other tubulars surrounding the multi-perforating assembly 102. The piercings can also be rotationally spaced sufficiently close to weaken the surrounding casing or other tubular in order to allow the casing or other tubular to be more easily broken by another tool or another action. As used herein, the term "tubular" is inclusive of casings, joints, and any other type of wellbore pipe.

The foregoing description of the embodiments, including illustrated embodiments, has been presented only for the purpose of illustration and description and is not intended to be exhaustive or limiting to the precise forms disclosed. Numerous modifications, adaptations, and uses thereof will be apparent to those skilled in the art.

What is claimed is:

1. An assembly, comprising:

a housing;

a rotor axially slidable within the housing and cooperating with the housing to convert axial movement of the rotor into rotation of the rotor with respect to the housing; and a multi-perforating cartridge rotationally fixed with respect to the rotor and operable to pierce multiple times in response to axial movements of the rotor, wherein the multi-perforating cartridge includes a slider coupled to the rotor, wherein the slider includes a blade rotationally coupled to a pivot pin of the slider to pivot between a forward non-piercing position and a reverse non-piercing position during axial movement of the slider, and wherein the blade is positioned to pass through a piercing position during travel between the forward non-piercing position and the reverse non-piercing position, a tip of the blade extending beyond an outer diameter of the housing in the piercing position.

2. The assembly of claim 1, wherein the rotor includes a rotor guiding arm for interacting with a profile of the housing for rotating the rotor in response to axial movement of the rotor with respect to the housing.

3. The assembly of claim 2, wherein:

the rotor guiding arm is positioned to interact with the profile of the housing for rotating the rotor in response to forwards axial movement of the rotor with respect to the housing; and the rotor includes a second rotor guiding arm positioned to interact with a second profile of the housing for rotating the rotor in response to reverse axial movement of the rotor with respect to the housing.

4. The assembly of claim 1, additionally comprising:

a cartridge housing having a first port and a second port;

a support pin axially fixed with respect to the cartridge housing and positioned between the first port and the second port for biasing the blade towards the piercing position during axial movement of the slider in both a forwards direction and a reverse direction; and one or more biasing springs positioned to bias the tip of the blade radially outwards past the support pin.

5. The assembly of claim 4, wherein:

the blade is positionable in the first port by a first spring;

the tip of the blade is positionable beyond the outer diameter of the housing by the support pin;

the blade is positioned to be biased towards the slider by the support pin; and the blade is positionable in the second port by one from the group consisting of the first spring and a second spring.

6. The assembly of claim 1, wherein:

the rotor is rotatable through a plurality of positions;

the multi-perforating cartridge includes a plurality of single-use perforating cartridges, each being actuatable by axial movement of the rotor at respective ones of the plurality of positions.

7. The assembly of claim 1, wherein:

the rotor is structured to cooperate with the housing to convert a finite number of strokes of the rotor into rotation of the rotor through a plurality of rotational positions;

the multi-perforating cartridge is operable to pierce a tubular surrounding the housing at each of the plurality of rotational positions; and the plurality of rotational positions is sufficiently numerous to enable the multi-perforating cartridge to sever the tubular into two pieces.

8. The assembly of claim 1, wherein the multi-perforating cartridge includes a blade includes an opening for taking core samples upon piercing.

9. An assembly for a wellbore, comprising:

a multi-perforator coupled with a multi-stroker tool through a swivel joint, the multi-perforator being responsive to axial movement by the multi-stroker tool in performing multiple rotationally spaced-apart piercings in a single run; and a multi-perforating cartridge rotationally fixed with respect to the rotor and operable to radially pierce multiple times during the single run, the multi-perforating cartridge including a slider coupled to the rotor, the slider including a blade rotationally coupled to a pivot pin of the slider to pivot between a forward non-piercing position and a reverse non-piercing position during axial movement of the slider, the blade being positioned to pass through a piercing position during travel between the forward non-piercing position and the reverse non-piercing position, the blade having a tip that extends beyond an outer diameter of the multi-perforating cartridge in the piercing position.

10. The assembly of claim 9, wherein the multi-perforator includes a rotor and a housing, the housing including a profile shaped to cooperate with the rotor to incrementally rotate the rotor through a plurality of rotational positions during axial movement of the rotor.

11. The assembly of claim 10, further comprising:

an additional multi-perforating cartridge, the multi-perforating cartridge and the additional multi-perforating cartridge operable to radially pierce in response to axial movement of the rotor in respective ones of the plurality of rotational positions.

12. The assembly of claim 10, wherein:

the blade is positionable in a first port of the housing by a first spring;

the tip of the blade is positionable beyond the outer diameter of the housing by a support pin;

the blade is positioned to be biased towards the slider by the support pin; and the blade is positionable in a second port of the housing by one from the group consisting of the first spring and a second spring.

13. The assembly of claim 9, wherein the multiple rotationally spaced-apart piercings are sufficiently close to sever a tubular surrounding the multi-perforator.

14. The assembly of claim 9, wherein the blade includes an opening for taking core samples upon piercing.

15. A method, comprising:

positioning a blade in a housing to a forward non-piercing position at which the blade rests in a first port of the housing, the blade being rotationally fixed with respect to a rotor that axially slides within the housing, the rotor cooperating with the housing to convert axial movement of the rotor into rotation of the rotor with respect to the housing;

moving the blade, in response to the rotor axially moving, from the forward non-piercing position to a first piercing position at which part of the blade extends radially beyond an outer diameter of the housing;

moving the blade, in response to the rotor axially moving, from the first piercing position to a reverse non-piercing position at which the blade rests in a second port of the housing;

moving the blade, in response to the rotor axially moving, from the reverse non-piercing position to a second piercing position at which part of the blade extends radially beyond the outer diameter of the housing; and moving the blade, in response to the rotor axially moving, from the second piercing position to the forward non-piercing position.

16. The method of claim 15, wherein moving the blade to the first piercing position and moving the blade to the reverse non-piercing position are in response to axial movement of a slider attached to the rotor in a forward direction, wherein moving the blade to the second piercing position and moving the blade to the forward non-piercing position are in response to axial movement of the slider in a reverse direction.

17. The method of claim 15, wherein moving the blade to the first piercing position and moving the blade to the second piercing position occur in a single run downhole of an assembly that includes the blade.

* * * * *